US005862630A

United States Patent [19]

Krumhauer et al.

[11] Patent Number: 5,862,630

[45] Date of Patent: Jan. 26, 1999

[54] DOOR CLOSER

[75] Inventors: Peter Krumhauer, Berlin; Thomas Salutzki, Witten, both of Germany

[73] Assignee: DORMA GmbH + Co. KG, Ennepetal, Germany

[21] Appl. No.: 733,226

[22] Filed: Oct. 17, 1996

[30] Foreign Application Priority Data

Oct. 17, 1995 [DE] Germany ..... 195 38 482.2

[51] Int. Cl.[6] ..... E05F 11/24

[52] U.S. Cl. ..... 49/341; 49/340

[58] Field of Search ..... 49/137, 339, 340, 49/341, 342; 16/51, 58, 62

[56] References Cited

U.S. PATENT DOCUMENTS

| | | | |
|---|---|---|---|
| 3,818,637 | 6/1974 | Vivier . | |
| 4,040,144 | 8/1977 | Lasier et al. . | |
| 4,231,192 | 11/1980 | Daugiras et al. . | |
| 4,419,786 | 12/1983 | Surko, Jr. . | |
| 4,653,229 | 3/1987 | Feucht et al. | 49/29 X |

FOREIGN PATENT DOCUMENTS

| | | |
|---|---|---|
| 3234319 | 3/1984 | Germany . |
| 3535506 | 4/1986 | Germany . |
| 0469342 | 6/1993 | Sweden . |

*Primary Examiner*—Jerry Redman
*Attorney, Agent, or Firm*—Nils H. Ljungman and Associates

[57] ABSTRACT

A hydraulic servo door closer in which the fixed coupling between the energy storage mechanism and the door piston has been neutralized. The fixed coupling is neutralized by the use of spring pistons which are pressurized by the closing spring, in addition to the door pistons which are conventionally present. The additional pressure chambers which are thereby formed, compared to a conventional door closer, are connected to one another on one hand by fixed channels, but on the other hand by controlled channels and/or throttles for the damping medium which is present in the door closer.

20 Claims, 7 Drawing Sheets

DOOR CLOSER

BACKGROUND OF THE INVENTION

1. Field of the Invention

The present invention relates to a hydraulic servo door closer which has different translation ratios as a function of travel and direction. The different translation ratios thereby significantly improve the ease of operation of a door equipped with the present invention.

The present invention preferably includes a door piston which is guided in a housing, whereby the drive shaft of the door piston can be connected to a door by means of a linkage. There can also be an energy storage mechanism in the form of a spring, which spring can store energy during the opening of the door and can release it again for a subsequent automatic closing process.

The servo door closer can have at least two different translation ratios, as a function of direction and of the distance travelled, whereby simultaneously, the fixed or solid coupling between the opening force and the closing force is preferably neutralized by the fact that, between the spring and the door piston, there can be at least one hydraulic transmission which can include at least one spring piston, the door piston and an inner piston inside the door piston, as well as the chamber which is defined by this inner piston and a housing which surrounds the inner piston.

During the closing phase, the door piston can be moved away from the spring piston. This movement is preferably achieved because the damping medium can penetrate between the door piston and the spring piston via a pocket which can be located in the housing.

2. Background Information

A process and a device for controlling the force of a closing device is described in German Patent No. 35 35 506 A1. The door is connected to the door frame by means of a closing device, which closing device is in the form of a door closer, and by means of linkage arms which are capable of pivoting in relation to one another. The control system for the different force required for the opening and subsequent automatic closing of the door is modified by the displacement of the end of the linkage which is at some distance from the door closing device, to appropriately modify the torque exerted by the closing device on the door in separate phases of the opening and closing of the door. This known system is a device which requires the input of outside energy, i.e. there is an electric motor which displaces a bar or translating part and simultaneously defines the position of the bar in a guide element. The motor control is accordingly set as a function of the desired opening angle.

U.S. Pat. No. 4,979,261 discloses a door closer with a variable coupling position. As a result of a gear wheel which is fastened to the closer shaft, which gear wheel rolls along the door, the engagement point of the linkage and thus of the entire moment curve is changed automatically. As a result of the use of the mechanical means described above, there is a reduction of the opening force and a simultaneous increase of the closing force.

U.S. Pat. No. 3,818,637 discloses a device which makes possible the rapid opening of a door.

A device which uses a linear force to open a door is disclosed in U.S. Pat. No. 4,231,192. In this device, a corresponding lever system is used in connection with an outside energy source in the form of an electric current to achieve an approximately linear curve of the force on the door as a function of the opening angle.

A door closer which works with two pistons is described in U.S. Pat. No. 4,040,144. This system also works with outside energy in the form of air.

U.S. Pat. No. 4,419,786 describes a system by means of which the force required to open a door in normal door opening situations is reduced. In this system, a door closer is used. As a result of the displacement of the far end of the linkage which is connected to the door closer, the force ratio is changed, below a defined opening angle, by the use of additional spring forces and a hydraulic or pneumatic control system. It is thereby possible to change the torque exerted on the door by the door closer by means of the articulated linkage system. This system is very complicated, and cannot be used universally or be adapted for all different types of operation.

A device in the form of a door closer which is described in Swedish Patent 469 342 consists of a housing in which two pistons are arranged so that they can move. There are also two springs, with each spring corresponding directly to a respective piston, wherein the two springs act in the same direction on the pistons. One piston is connected to a piston rod, the rear end of which piston rod is located in a sealed manner in a central boring in the other piston. The two pistons have different diameters. The fluid flow of the damping medium through the piston is controlled by means of various channels in connection with valves. As a result of these measures, the force required to open the door is small, although a large force is still provided for the final phase of the closing process.

To reduce the opening moment, German Laid Open Patent Application No. 32 34 319 discloses a device in which the required greater closing force is applied by means of an outside energy source to provide a spring bias. In this known device, the additional spring bias can be generated both by an electric motor and by a piston with a hydraulic circuit which is powered by outside energy.

OBJECT OF THE INVENTION

The object of the invention is to significantly improve and simplify a door closer so that with a high closing moment, only a small opening moment is required to open the door. For this purpose, no outside energy is used, and at the same time, such a door closer can be manufactured more economically and can be installed more easily than disclosed in Swedish Patent 469 342.

SUMMARY OF THE INVENTION

The present invention teaches that the object can be accomplished in that the fixed coupling between the opening and closing force, which coupling is present in known similar devices, is neutralized. The fixed coupling is neutralized because, in addition to the door piston which can be normally present, there can be an additional spring piston which can be pressurized by the closing spring. The additional pressure chambers which are thereby formed in addition to the pressure chambers of a standard door closer are connected to one another on one hand by fixed channels, but also are connected to one another by controlled channels or throttles for the damping medium which is present in the door closer.

In other words, the present invention teaches that the object can be accomplished in that a fixed coupling between the opening and closing force is not maintained during the opening and closing processes of the invention. By preferably including a hydraulic transmission with an actuator and an energy storage device, a door closer that can generate a high closing moment for closing a door, but only requiring a small opening moment for opening the door, can be achieved.

As a result of the inclusion of at least one second hydraulic transmission, the transmission of force for the opening and closing processes can preferably be controlled separately. During the opening process and the subsequent first part of the closing process of the door, this additional hydraulic transmission has a force translation ratio of U=1. On account of the decreasing closing angle which is caused by the release of the energy stored in the energy storage mechanism, a range is achieved in which the force translation ratio U<1. In this range, the closing moment is lower. Only in a further portion of the closing phase, namely in the range where the door is designed to fall into the closed position, is the force translation ratio U>1 reached. This system makes it plain that the closing moment can be greater than the opening moment.

In one embodiment of the present invention, the door piston is provided with an additional piston, namely an inner piston. This inner piston can be inside the door piston and can be controlled via channels and pockets which can be located both in the door piston and in the outer wall of the housing, which outer wall can enclose the piston. In contrast to the door piston and spring piston, the position of the inner piston is preferably fixed. The inner piston can be connected to the housing by means of a positive and non-positive connection.

In other words, in one embodiment of the present invention, the door piston can be provided with an internal chamber. An additional inner piston can be provided within the internal chamber of the door piston, sealingly dividing the internal chamber into two chamber portions, each chamber portion being located on opposite sides of the inner piston from one another. The inner piston is preferably fixedly connected to the housing. By displacing the door piston, the volume of each chamber portion and their relative size with respect to each other can be changed.

When the door is closed, both the door piston and the spring piston can be in a position in which surfaces of their two pistons are in contact with one another. As a result of the spring force, the spring piston can be pressed against the door piston. A door piston chamber can be formed on the side of the door piston opposite the spring piston, and a spring chamber can be formed on the side of the spring piston opposite the door piston. The two chambers can be connected to one another by means of a channel. Inside this channel there can be a valve which is preferably realized in the form of a throttle valve. In an alternative embodiment of the present invention, it can also be possible to install a flow control valve at this location. In the area in which the door piston and the spring piston come to rest in the idle position, an additional channel can end in the vicinity of the piston surfaces which are in contact with one another, which additional channel can also form a connection to the spring piston chamber.

But, the spring piston chamber can also be connected by means of an additional channel which is preferably located in the housing and ends in a pocket, which pocket in turn can be connected with a channel in the door piston, which channel can be open in this limit position. Inside this channel there can be a non-return valve which can permit the fluid equalization of the damping medium only from the spring piston chamber toward the spring piston. From this channel, a channel can also run simultaneously to an inner piston chamber which is located upstream, or in front, of the inner piston, but which inner piston chamber can be filled up by the inner piston when the door is in the closed position.

Since the door piston can be moved by means of the inner piston, there is preferably also an inner piston chamber on the facing side of the spring piston. This inner piston chamber can be connected continuously to the door piston chamber by means of a channel. If the door is opened, both the door piston and the spring piston can be moved simultaneously toward the side wall of the housing, where the spring is preferably supported.

But, the inner piston can move quasi-opposite to this direction, because the damping medium can be displaced through the corresponding channel only in one direction, on account of the preferable presence of the non-return valve. Consequently, the damping medium can be discharged from the previously filled inner piston chamber, through the channel not pressurized by a valve, into the door piston chamber.

As a result of the displacement of the door piston, an inner piston chamber can thereby be formed on the other side, which inner piston chamber can be connected to a pocket located in the housing. The pocket preferably simultaneously ends in the area which can hold the spring piston to the maximum extent on account of the open position of the door.

In other words, the door piston and the inner piston can be moved with respect to one another. As the door piston moves in the opening phase of the door closer operation, a relative opening displacement between the door piston and the inner piston can occur. Likewise, in the closing phase of door closer operation, a relative closing displacement between the door piston and the inner piston can occur.

The relative opening displacement between the door piston and the inner piston can occur as the door piston is moved towards the side wall of the housing as the door opens. The relative opening displacement between the door piston and the inner piston allows the inner piston chamber to expand. Damping medium can flow into the expanding inner piston chamber through a channel that can include a non-return valve. The non-return valve preferably allows flow of damping medium into the inner piston chamber upon relative opening displacement between the door piston and the inner piston.

Upon a subsequent relative closing displacement, the inner piston chamber can contract. The damping medium can be discharged from the previously filled inner piston chamber, through another channel not connected to the non-return valve, to allow flow of damping medium out of the inner piston chamber during the closing of the door.

In the piston surface of the spring piston, and/or in the piston surface of the door piston, there can be a small recess or offset which can extend to the vicinity of the pocket which connects with the inner piston chamber. This connection is necessary, in an embodiment of the present invention, so that, during the subsequent closing process, an increased pressure buildup can preferably be achieved between the door piston and the spring piston. As a result of this increased pressure, it is ensured that during the closing of the door, the door piston moves away from the spring piston, i.e. the door piston moves faster than the spring piston, and at the same time, the inner piston moves back with a relative displacement in the direction of the spring piston.

That means that the door is already closed by the door piston, although the spring piston has not yet reached its limit position, namely contact with the door piston. As a result of this inventive step, it is apparent that the spring is not yet relaxed, and thus a higher closing force is available. Then, the spring piston and the door piston move toward one another once again, to the point where the piston surfaces come in contact with one another, when a pressure equalization is achieved via the correspondingly switched channels.

In an additional embodiment of the present invention, a door closer can be realized that reduces the risk of catching one's fingers within the closing door. The door closer can generate a high seating or latching force once the door has substantially reached the door's closed position within the door frame. Because the seating force can in this embodiment be preferably applied after the door has, in effect, reached the door's closed position in the door frame, the seating force can be applied to the door as a static load to engage the door latch. It is therefore not necessary to cause the door to accelerate towards the door frame or have the door close at a high closing speed so as to generate kinetic energy that would be converted to the desired closing force upon impact with the door latch. The elimination of the closing acceleration or the high speed closing of the door reduces the risk of inadvertently catching one's fingers within the closing door.

In a further embodiment of the present invention, a door closer for connection between a door and a door frame can be realized. The door closet can include a housing, the housing being configured for attachment to one of the door and the door frame, a piston structure disposed in the housing, apparatus for connecting the piston structure to the other of the door and the door frame, energy storage apparatus for storing energy during the opening of the door for subsequently closing the door, the energy storage apparatus also disposed in the housing, apparatus for moving both the piston structure and the energy storage apparatus during an opening movement of the door, apparatus for moving the piston structure and the energy storage apparatus during a closing movement of the door and for moving the piston structure at a substantially higher speed than the spedd of the energy storage apparatus during a substantial portion of the closing movement of the door.

In a further additional embodiment of the present invention, a door closer for connection between a door member and a door frame member can be realized. The door closer can include a housing, the housing being configured for attachment to one of the door member and the door frame member, a piston structure disposed in the housing, apparatus for connecting the piston structure to the other of the door and the door frame, energy storage apparatus for storing energy during the opening of the door member for subsequently closing the door member, the energy storage apparatus also being disposed in the housing, apparatus for moving both the piston structure and the energy storage apparatus during an opening movement of the door member, and apparatus for moving the piston structure and the energy storage apparatus during a closing movement of the door member and for moving the piston structure a substantially greater distance than the distance of movement of the energy storage apparatus during a portion of the closing movement of the door member.

In yet a further additional embodiment of the present invention, a door closer for connection between a door and frame can be realized. The door closer can include a housing, the housing being configured for attachment to one of door and the frame members, a piston structure disposed in the housing, the piston structure being moveable in a first direction and a second direction, the second direction being substantially opposite the first direction, apparatus for linking the piston structure to the other of the door and frame members, the apparatus for linking for moving the piston structure in the first direction in response to movement of the door member in an opening direction relative to the frame member and for moving the door member in a closing direction in response to movement of the piston structure in the second direction, energy storage apparatus for storing energy in response to movement of the door member in an opening direction relative to the frame member for subsequently closing the door member, the energy storage apparatus also being disposed in the housing, the energy storage means being moveable in a third direction and a fourth direction, the fourth direction being substantially opposite the third direction, and transmission apparatus for operatively connecting a portion of the movement of the piston structure in the second direction and the energy storage apparatus in the fourth direction in response to a substantial portion of the movement of the door member in a closing direction relative to the frame member and for moving the piston structure a substantially greater distance than the distance of the energy storage means.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below on the basis of one possible embodiment which is illustrated schematically in the accompanying drawings, wherein.

DESCRIPTION OF THE PREFERRED EMBODIMENT

Figure 1:
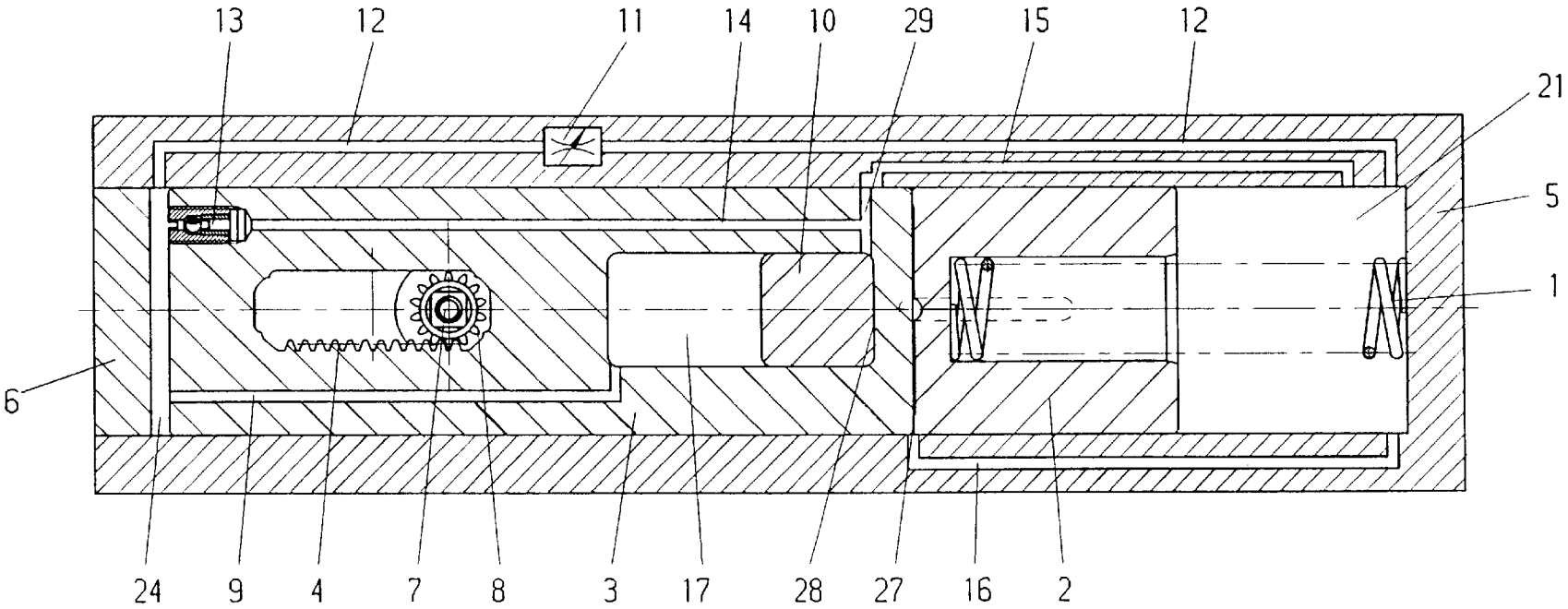
FIG. 1 shows one possible embodiment of a servo door closer in a sectional view on a closed door.
Figure 1A:
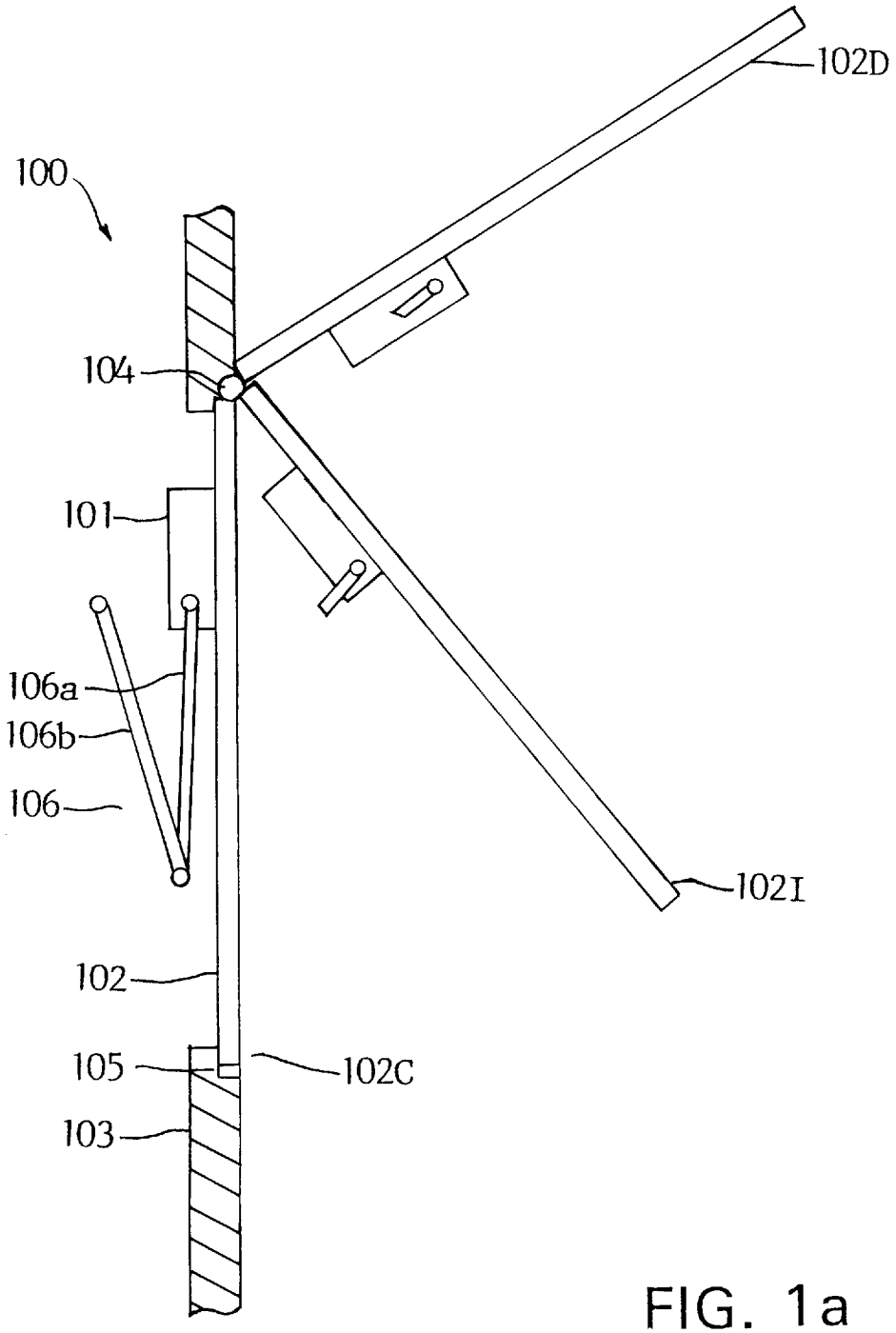
FIG. 1*a* shows a diagrammatic view of a doorway in which the servo door closer of FIGS. 1–6 could be incorporated.

FIG. 1*a* illustrates a doorway 100 in which a door closer 101 can be employed in accordance with the proposed invention. The door closer 101 can be attached to a door 102, the door 102 being mounted in a door frame 103. The door 102 can rotate about a hinge 104 for moving between an opened position and a closed position. A door latch 105 can be located in the door frame 103 to secure the door 102 in the closed position.

The door closer 101 can be connected to the door frame 103 via a linkage 106. The linkage 106 can be embodied by an articulated linkage having arm 106*a* and arm 106*b*. An end of arm 106*a* can be attached to the door closer 101, and the end of arm 106*b* can be connected to the door frame 103. The use of linkages to connect a door, door frame and door closer are well known and will not be discussed in further detail.

It is readily apparent that the door 102 can take an infinite number of intermediate positions between the opened and closed positions of the door. FIG. 1*a* illustrates the door 102 in a closed position, corresponding to position "102C", an opened position, corresponding to position "102O", and an intermediate position corresponding to position "102I". As the door 102 executes a rotation about hinge 104, the attached end of linkage arm 106*a* makes a relative rotation about the door closer 101 (only a portion of arm 106*a* is shown for door positions "102O" and "102I").

It is readily apparent that the doorway 100 may vary from that illustrated in FIG. 1*a*. For example, the door 102 may be realized in the form of a sliding door. The door closer 101 could be attached to the door frame 103 rather than to the door 102, or the door closer 101 could be mounted on the opposite side of the door 102. Other types of linkages 106 could be employed to operatively connect the door closer 101, the door 102 and the door frame 103.

When the door 102 is closed, a door closer 101 as illustrated in FIG. 1 is in a position where a drive shaft 7, with a pinion 8 located on the drive shaft 7, has reached one end of a gearing 4.

The pinion 8 can be connected to the arm 106*a* of the linkage 106, whereby relative rotation of the arm 106*a* about the door closer 101 rotates the pinion 8 with respect to the gearing 4.

The gearing 4 is preferably located in a door piston 3. The door piston 3, on account of a spring 1 and a spring piston 2 located between the door piston 3 and the spring 1, is pushed toward an end of the door closer 101, namely toward a closure 6 of the door closer 101. The space remaining between the closure 6 and the door piston 3, namely a door piston chamber 24, can thereby be preferably very small. This door piston chamber 24 can be connected by means of a channel 12 to a spring chamber 21. The channel 12 can thereby be preferably located in an outer wall of a housing 5 which surrounds the door piston 3. Inside the channel 12 there can be a valve 11. This valve 11 is preferably realized as a throttle valve which regulates the flow of the damping medium which flows through the channel 12. In an alternative embodiment of the present invention, the valve 11 can be realized as a flow control valve.

As a result of the approximately relaxed spring 1, the volume of the spring chamber 21 can be preferably large compared to the volume of the door piston chamber 24. The spring chamber 21 can also be connected by means of a channel 16 up to a point which represents a limit position 27 of the door closer 101 when the door 102 is closed. This limit position 27 substantially corresponds to an angular position of the door 102 of 0 degrees (that is, the door is closed). In this range, the spring piston 2 and the door piston 3 can lie with their respective piston surfaces 25 and 26 (see FIG. 3) facing one another.

The gearing 4 is preferably in the door piston 3, and on account of the pinion 8 which is connected to the drive shaft 7, the gearing 4 can move the door piston 3 out of the position shown in FIG. 1 by an actuation of the door (not shown). The drive shaft 7 can thereby be connected to the door or the door casing or the door frame by means of a linkage 106 or actuation arm (not shown here, but see FIG. 1*a*).

Inside the door piston 3 there can be an additional piston, namely an inner piston 10. The inner piston 10 can be positively and non-positively connected to the housing 5. As a result of the presence of an inner piston chamber 17, the door piston 3 is capable of moving by means of the inner piston 10 in the longitudinal direction of the housing 5. In the limit position 27 of the door closer 101, when the door 102 is preferably in the closed position, the inner piston 10 at a surface 28 is preferably inside the door piston 3. The inner piston chamber 17 can be located on the other side of the inner piston 10 from the surface 28, and can be connected to the door piston chamber 24 by means of a connecting channel 9. Thus the damping medium can penetrate from the door piston chamber 24 into the inner piston chamber 17.

Inside the door piston 3 there can be an additional channel 14 which can also start from the door piston chamber 24. This channel 14 can end in the vicinity of the surface 28 and thus inside the inner piston chamber 17. There can be also a connection 29 to a channel 15 which is located inside the housing 5. This channel 15 can end on the other side in the spring chamber 21. In the vicinity of the channel 14, a non-return valve 13 can be installed so that the damping medium can preferably flow only from the door piston chamber 24 through the channel 14.

In this limit position 27, therefore, in addition to the pressure equalization by means of the channel 12 from the door piston chamber 24 to the spring chamber 21, it is also possible to achieve a pressure equalization between the door piston chamber 24 and the spring chamber 21 via the channel 14 and the channel 15.

Figure 2:
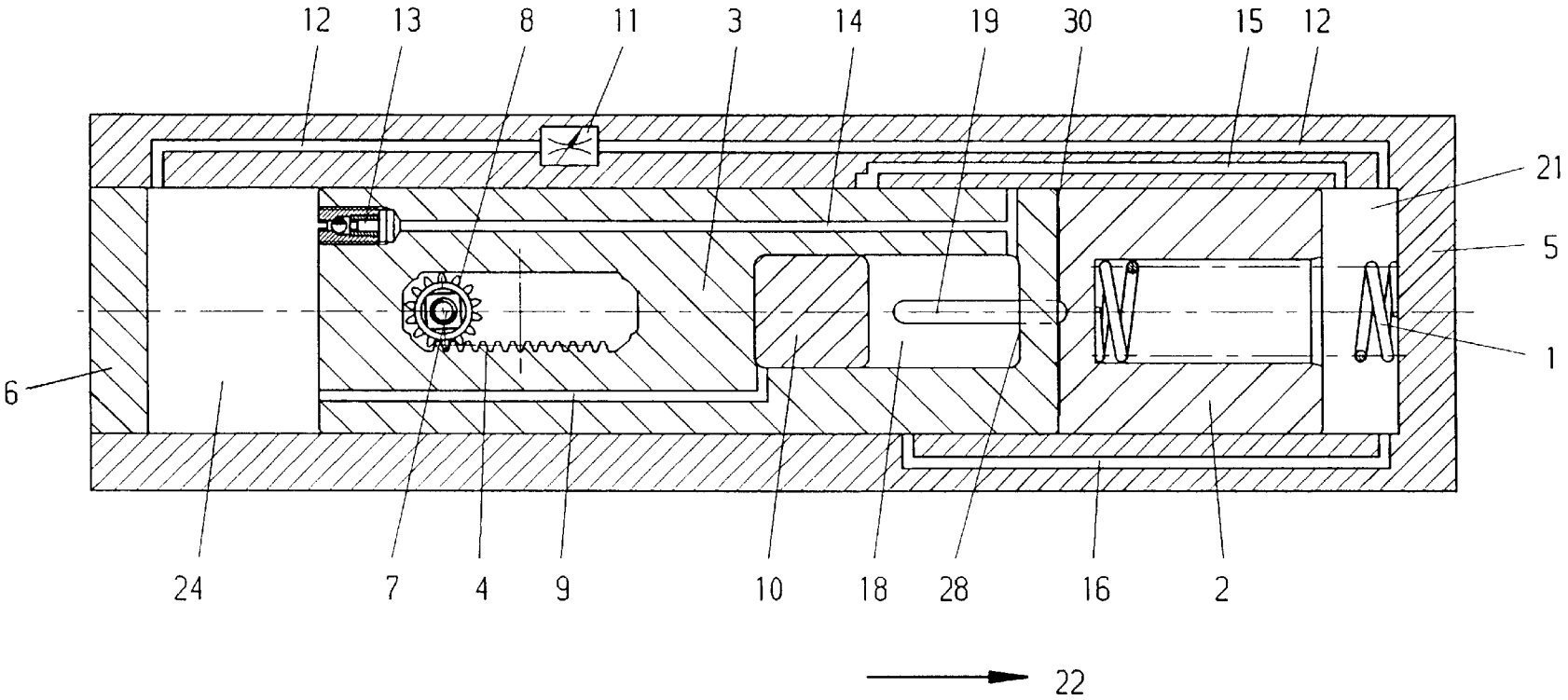
FIG. 2 shows the possible embodiment of a servo door closer in a sectional view on an opened door.

As shown in FIG. 2, when the door 102 is actuated into the open position, the pinion 8 can be rotated by means of the drive shaft 7, as a result of which the door piston 3 is preferably displaced in the direction of motion 22 by means of the gearing 4 of the door piston 3. Simultaneously with the door piston 3, the spring piston 2 which is lying in front of the door piston 3 can be displaced in the same direction. The spring 1 is preferably placed under tension simultaneously with the displacement of both the door piston 3 and the spring piston 2. As a result of the displacement of the door piston 3 and of the spring piston 2, the damping medium can be transported out of the spring chamber 21 via the channel 12 with the valve 11 between them into the door piston chamber 24, which door piston chamber 24 is then becoming larger. The channel 15 is irrelevant for this functional sequence, as is the channel 16 during the opening of the door 103.

As a result of the opening movement, as shown in FIG. 2, the damping medium will flow out of the spring chamber 21, through the channel 12 with the valve 11, into the door piston chamber 24, and from there, out via the non-return valve 13 into the channel 14. An inner piston chamber 18 is thereby filled with damping medium (preferably oil). Because the door piston 3 is displaced, the inner piston chamber 18 filled with damping medium is formed on the side of the inner piston 10 where the channel 14 ends. The inner piston chamber 17 which was previously filled with damping medium is either reduced in size or is completely eliminated by the displacement of the door piston 3. The damping medium in the inner piston chamber 17 can flow out via a connecting channel 9 into the door piston chamber 24.

Then, if the door 102 which was previously opened is let go, on account of the energy which is stored in the spring 1, the door 103 can be automatically and slowly returned to the closed position. The spring 1 can thereby push the spring piston 2 and also the door piston 3 in the direction of movement 23. On account of a pocket 19 which is preferably present inside the housing 5, which pocket 19 is placed so that when the door 102 is completely open, the pocket 19 spans or contains in its longitudinal dimension approximately the inner piston chamber 18, but at the same time the pocket 19 preferably extends far enough beyond the door piston 3 so that an end 30 of the pocket 19 extends or is placed so that when the door 102 is fully open the door piston surface 25 and the spring piston surface 26 are covered or overlapped by the end 30.

Figure 3:
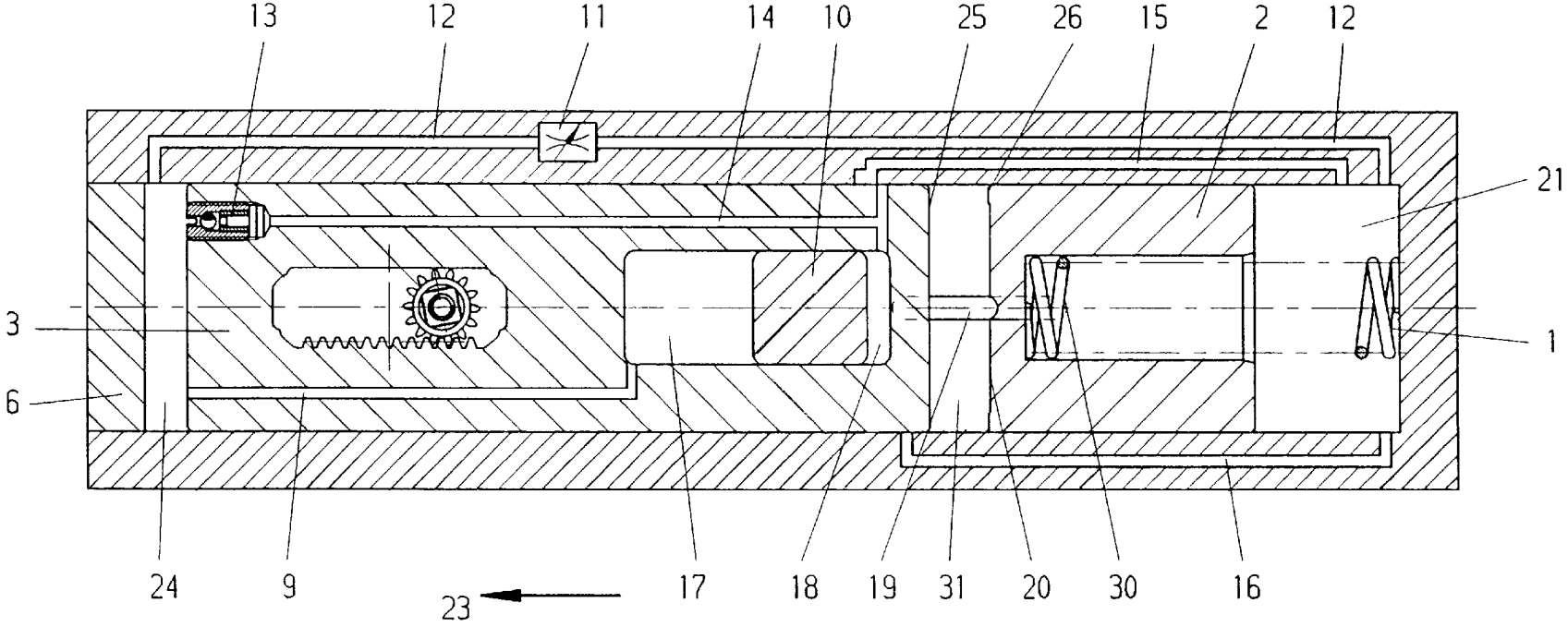
FIG. 3 shows the possible embodiment of a servo door closer in a sectional view, with the door piston at some distance from the spring piston.

In the illustrated embodiment, there is a recess or offset 20 (see FIG. 3) in the spring piston 2. This recess 20 can also be introduced into the door piston 3. This recess 20 is necessary in the illustrated embodiment so that when the door 102 begins to close, a pressure buildup can be achieved between the door piston 3 and the spring piston 2. The pressure buildup can be achieved because the damping medium is preferably between the inner piston 10 and the surface 28, as shown in FIG. 3. But, since the pocket 19 is also located in this area, the damping medium penetrates via the pocket 19 into the recess 20.

In other words, the recess 20 can form a chamber 31 between the door piston 3 and the spring piston 2. The end 30 of pocket 19 can extend to the chamber 31 when the door is in its opened position as illustrated in FIG. 2. The inner chamber piston 18 can be thereby preferably be in fluid communication with the chamber 31 via pocket 19 when the door 102 is in its opened position as illustrated in FIG. 2.

Consequently, a pressure is built up which displaces the door piston 3 more rapidly, but with less force, than the spring piston 2 in the direction of movement 23. This process is supported because the damping medium flowing out of the door piston chamber 24 is controlled by the valve 11 so that a lower pressure equalization is possible via the channel 12 than via the channel 14. Moreover, on account of the pressure equalization out of the door piston chamber 24, the damping medium will also flow via the connecting channel 9 into the inner piston chamber 17.

In other words, when the door 103 as positioned in FIG. 2 is released, the spring 1, previously compressed by the opening of the door, can apply a biasing force against spring piston 2 in the direction of the closure 6. Because the spring piston 2 abuts the door piston 3, the biasing force applied against the spring piston 2 is also applied to the door piston 3, and the spring piston 2 and the door piston 3 will at first begin to move together towards the closure 6. The displacement of the door piston 3 also displaces gearing 4, causing the pinion gear 8 to rotate and drive the drive shaft 7 to move the door in its closing direction.

As the door piston 3 begins to move towards the closure 6, the volume of inner spring chamber 18 is reduced and the damping fluid pressure within inner spring chamber 18 increases. However, non-return valve 13 prevents damping medium from escaping the inner spring chamber 18 via channel 14, as the non-return valve 13 only allows a direction of flow of damping medium into the inner spring chamber 18. Therefore damping medium contained in the inner spring chamber 18 is forced to flow through pocket 19 and into the chamber 31.

The flow of damping medium from inner spring chamber 18 and into the chamber 31 reduces the volume of damping fluid within inner spring chamber 18, allowing door piston 3 to continue moving towards closure 6. At the same time, the chamber 31 must expand in volume to accomodate the flow of damping fluid from inner spring chamber 18 and into the chamber 31. The expansion of chamber 31 to accommodate the flow of damping medium from inner spring chamber 18 causes the door piston 3 and the spring piston 2 to separate from one another as the chamber 31 expands, as illustrated in FIG. 3.

Because the end 30 of pocket 19 is in communication with the chamber 31 when the door 102 is in the open position (as illustrated in FIG. 2), the door piston 3 effectively begins to separate from the spring piston 2 immediately upon the release of the door. However, in another embodiment of the present invention, the end 30 of pocket 19 would not extend to the chamber 31. Upon release of the door 102, both the door piston 3 and the spring piston 2 would move together towards the closure 6. At least one additional channel (not shown) could be located to allow damping medium to drain from the inner spring chamber 18 and equalize the pressure in inner spring chamber 18 as the door piston 3 and the spring piston 2 move towards the closure 6.

At some point, the chamber 31 would reach the end 30 of the pocket 19, and the additional channel would close. Damping medium flow would then commence between the inner spring chamber 18 and the chamber 31, causing the door piston 3 and the spring piston 2 to separate in the same manner as discussed above. By varying the location of the end 30 of the pocket 19, the beginning of the separation of door piston 3 and the spring piston 2 as the door 102 closes can be varied to suit particular needs. Only beginning at a specified opening angle of the door 102 can a control by means of the pocket 19 be activated, which effects a separation of the door piston 3 from the spring piston 2.

As a result of such a process, it is possible for the door closer 101 to have at least three different translation ratios, and thus different moment curves as a function of distance and direction of travel. As a result of the teaching of the present invention, a substantial and essentially unlimited number of additional hydraulic transmissions can be interposed, which would result in effectively an unlimited number of different translation ratios. As a result of the elimination of the fixed coupling between the door piston 3 and the spring piston 2, the translation ratio is therefore no longer 1.

As the door 102 approaches its closed position, the connection 29 preferably coincides with the channel 15, and simultaneously the pocket 19 is preferably closed by the door piston 3, which means that a more rapid equalization of the damping medium from the inner piston chamber 18 to the spring chamber 21 can be achieved. In the vicinity of the closed position, as a result of the selected position of the channel 16, the damping medium which is in the chamber 31 is able to flow out into the spring chamber 21. A pressure equalization takes place between the door piston 3 and the spring piston 2. This channel 16 can also preferably have a throttled cross section, to guarantee that the elevated force is still present for a brief time in the closed position. In an alternative embodiment, an additional throttle can be used, or the cross section of the channel 16 can be reduced.

To paraphrase, as the door piston 3 approaches its closed position, the flow of damping medium between the inner spring chamber 18 and the chamber 31 is closed. To prevent remaining damping medium from being trapped within the inner spring chamber 18 as the door piston 3 continues to approach the closed position, the connection 29 opening into the inner spring chamber 18 preferably coincides with the channel 15. Damping medium trapped within the inner spring chamber 18 could impede the door piston 3 from reaching the closed position. The flow connection 29 now allows damping medium to flow via channel 15 from the inner spring chamber 18 and into the spring chamber 21, allowing the release of damping medium from the inner spring chamber 18 as the inner spring chamber 18 continues to decrease in volume with the continuing displacement of the door piston 3 to its closed position.

Upon the closing of flow of damping medium between the inner spring chamber 18 and the chamber 31, damping medium is trapped within the chamber 31 between the spring piston 2 and the door piston 3. Because the spring piston 2 has not yet reached its closed position, the spring storage mechanism 1 has not yet returned to its maximum working length. The remaining residual compression of spring storage mechanism 1 allows a greater spring force to be transmitted from the spring piston 2 to the door piston 3 through the pressurized damping medium trapped within chamber 31 than could occur if the spring piston 2 directly pushed the door piston 3 to close the door 102.

By means of the hydraulic damping and switching means, therefore, a controlled, damped movement of the door piston 3 and of the spring piston 2 can be realized. When the door 102 is being opened, which can be done either manually or by a power-actuated drive system, and during the subsequent closing process, which can in an embodiment of the present invention be possible exclusively and solely by the energy stored in the spring storage mechanism 1, up to a door opening angle which can be specified and thus selected individually, the spring piston 2 and the door piston 3 can be moved by a pressure equalization between all of the piston chambers filled with hydraulic fluid at the same speed.

Only beginning at a specified opening angle of the door 102 can a control by means of the pocket 19 be activated, which effects a separation of the door piston 3 from the spring piston 2. The door piston 3 thereupon moves away from the spring piston 2, which represents a lower translation ratio.

Figure 4:
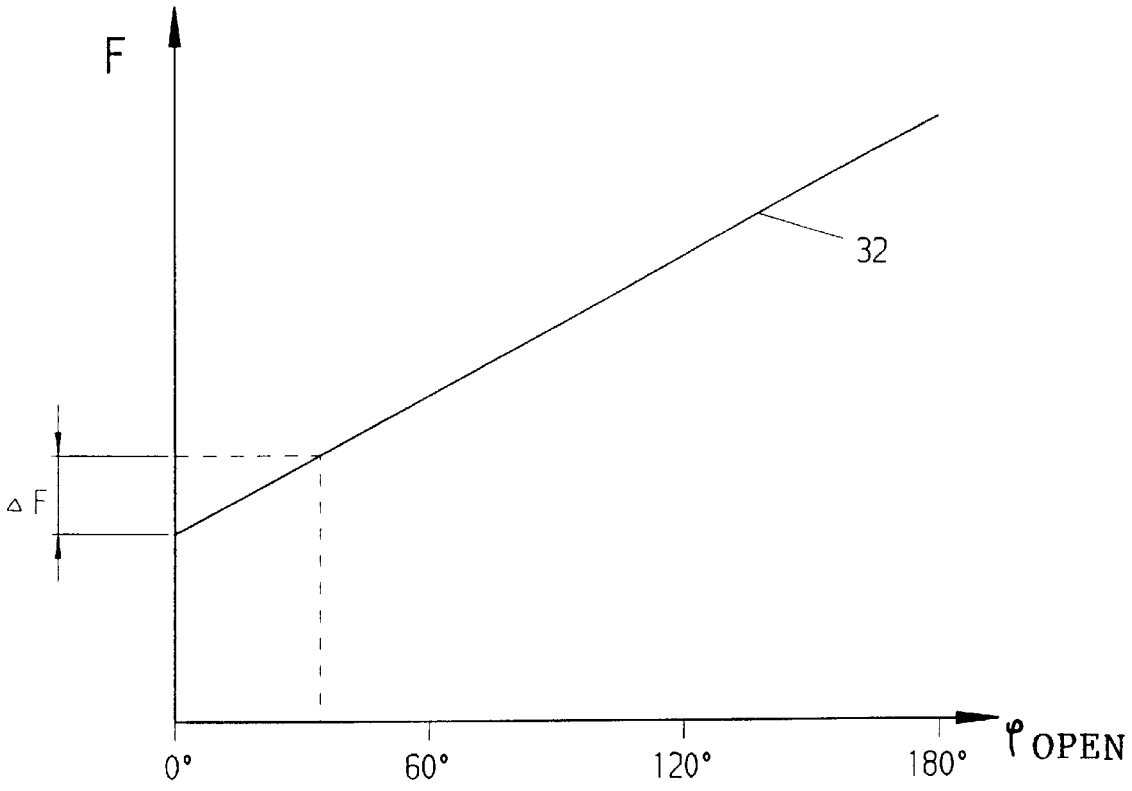
FIG. 4 is a diagram of the spring characteristic of the possible embodiment of a servo door closer.

FIG. 4 is a diagram which shows the force of the spring 11 plotted over the opening angle of the door 102. The spring characteristic 32 shows that as the opening angle increases from 0 degrees (corresponding to a closed position of the door 102) to approximately 180 degrees (corresponding to an opened position of the door 102), the force F in the spring increases. Then if the door 102 is moved into the closed position as indicated above, the door piston 3 has already reached its limit position by means of the drive shaft 7 with the linkage connected to it. But the spring piston 2 has not yet travelled the entire distance, because it moves at a lower speed, and has not yet reached its limit position. The chamber 31 is still filled with damping medium under high pressure. That means that there is a closing moment which is higher than normal by delta-F, which ensures that the door 102 will also securely reach the closed position.

Only by the controlled discharge of the high pressure out of the chamber 31 via the channel 16 are the piston surfaces 25 and 26 of the spring piston 2 and the door piston 3 made to approach and ultimately come into contact with one another. As a result of this inventive step, the hydraulic servo door closer 101 is capable, in the final range of the closing process, where a door latch or bolt of the lock of the door 102 is designed to securely engage the edge plate of the door 102, of applying an increased force, which force is then reduced again as the spring piston 2 approaches the door piston 3. During a subsequent opening of the door 102, the door piston 3 and the spring piston 2 are once again in their base position (as shown in FIG. 1), and move at the same speed in the direction of movement 22.

In other words, when the door piston 3 reaches substantially its closed position, it is desirable the door closer 101 be capable of generating a closing force that is larger than the force required to open the door 102. This larger closing force allows a door latch or door bolt to securely engage the edge plate of the door 102. Hence the larger closing force can generate an engagement force that is needed to successfully close and latch the door 102, but would otherwise be a hindrance or is otherwise not necessary to overcome during the opening of the door 102. As described above, with the illustrated embodiment the creation of chamber 31 during the closing of the door 102 allows a higher closing force to be applied to the door 102 when the door 102 reaches substantially its closed position than is necessary to open the door 102.

Once the door 102 effectively reaches its closed position, the spring piston 2 should preferably move to its closed position abutting the door piston 3. This allows the spring storage mechanism 1 to be extended to its maximum length, thereby reducing the opening force needed to initially displace the spring piston 2 and to begin compressing the spring storage mechanism 1 during the opening phase of the operation of door closer 101. When the door piston 3 reaches its limit closed position, the channel 16 opens to drain the damping medium within chamber 31 to the spring chamber 21. This allows the spring piston 2 to move to its closed position immediately adjacent the door piston 3, returning the door closer 101 to its initial operating position as illustrated in FIG. 1.

However, in an alternative embodiment of the present invention, the channel 16 can include a throttled cross section, or include a throttling valve, or include a reduced area cross-section. By throttling or restricting the flow from chamber 31 to spring chamber 21 after the door piston 3 has reached its closed position, the exiting flow from chamber 31 is controlled. The throttled flow in channel 16 can allow an elevated pressure, and therefore an elevated force, to be applied to the door piston 3 via the chamber 31 when the door piston 3 is in its closed position for a portion of the time the damping medium is draining from chamber 31. Thus an elevated force can be applied to the door piston 3 even when the door piston 3 has reached its closed position.

To paraphrase, the door closer 101 can have more than one translation, or transmission, ratio. As the door 102 is opened, the door piston 3 and the spring piston 2 are simultaneously displaced. Because the spring piston 2 is pushed by the door piston 3, the displacement of the spring piston 2 is the same as the displacement of the door piston 3, and hence the compression of the storage spring mechanism 1 during the opening of the door 102 is the same as the displacement of the door piston 3. Therefore during the opening phase of the door closer operation, the translation ratio, or the ratio of spring piston 2 displacement to displacement of the door piston 3, is equal to 1.

During the subsequent first part of the closing phase of the door 102, the door piston 3 and the spring piston 2 can return towards the closed position with the spring piston 2 pushing the door piston 3. This first part of the closing phase lasts for as long as there is no fluid medium communication between the inner spring chamber 18 and the chamber 31 to separate the spring piston 2 from the door piston 3. During this first part of the closing phase, the translation ratio, or the ratio of spring piston 2 displacement to displacement of the door piston 3, is equal to 1.

As described earlier above, the first part of the closing phase of the door 102 can, in effect, be eliminated by having the end 30 of the pocket 19 preferably extend so that when the door 103 is fully open, the door piston surface 25 and the spring piston surface 26 are covered or overlapped by the end 30. In such an embodiment of the present invention, the above described first part of the closing phase of the door 102 can essentially be eliminated.

Upon reaching a predetermined closing position, damping medium can begin to be introduced into the chamber 31, as previously described, to separate the door piston 3 from the spring piston 2 as the door enters a second part of the closing phase. During this second part of the closing phase, damping medium flows into chamber 31, increasingly separating the door piston 3 from the spring piston 2. Hence the displacement of the spring piston 2 is less than the displacement of the door piston 3, and therefore during this second part of the closing phase, the translation ratio, or the ratio of spring piston 2 displacement to door piston 3 displacement, is less than 1.

Because of the decoupling or separation of the door piston 3 from the spring piston 2 and the resulting translation ratio being less than 1, the door piston 3 in the second part of the closing phase can reach substantially its closed position with respect to the door closer 101 prior to the spring piston 2 reaching its closed position. This allows the storage spring mechanism 1 to retain a portion of the energy stored within the storage spring mechanism 1 when the door 102 was opened, and thereby apply a larger closing force to the door piston 3 than would be possible if the decoupling or separation of the door piston 3 from the spring piston 2 did not occur.

In the final phase of the closing process, the door piston 3 has reached substantially its closed position. The pocket 19 coupling the inner spring chamber 18 to the chamber 31 is now closed, and the inner spring chamber 18 can communicate with the spring chamber 21 to allow the door piston 3 to reach its closed position. The pressurized damping medium contained within the chamber 31 exerts a force on the door piston 3 to move the door piston 3 to its closed position. A channel thereby opens to drain the chamber 31 to the spring chamber 21, allowing the spring piston 2 to move to its closed position adjacent the door piston 3. During the final phase of the closing process, the spring piston 2 can be displaced a greater distance than the door piston 3 for the door closer 101 to return to its closed position. Hence during this final phase of the closing process, the translation ratio, or the ratio of spring piston 2 displacement to door piston 3 displacement, is greater than 1.

Figure 5:
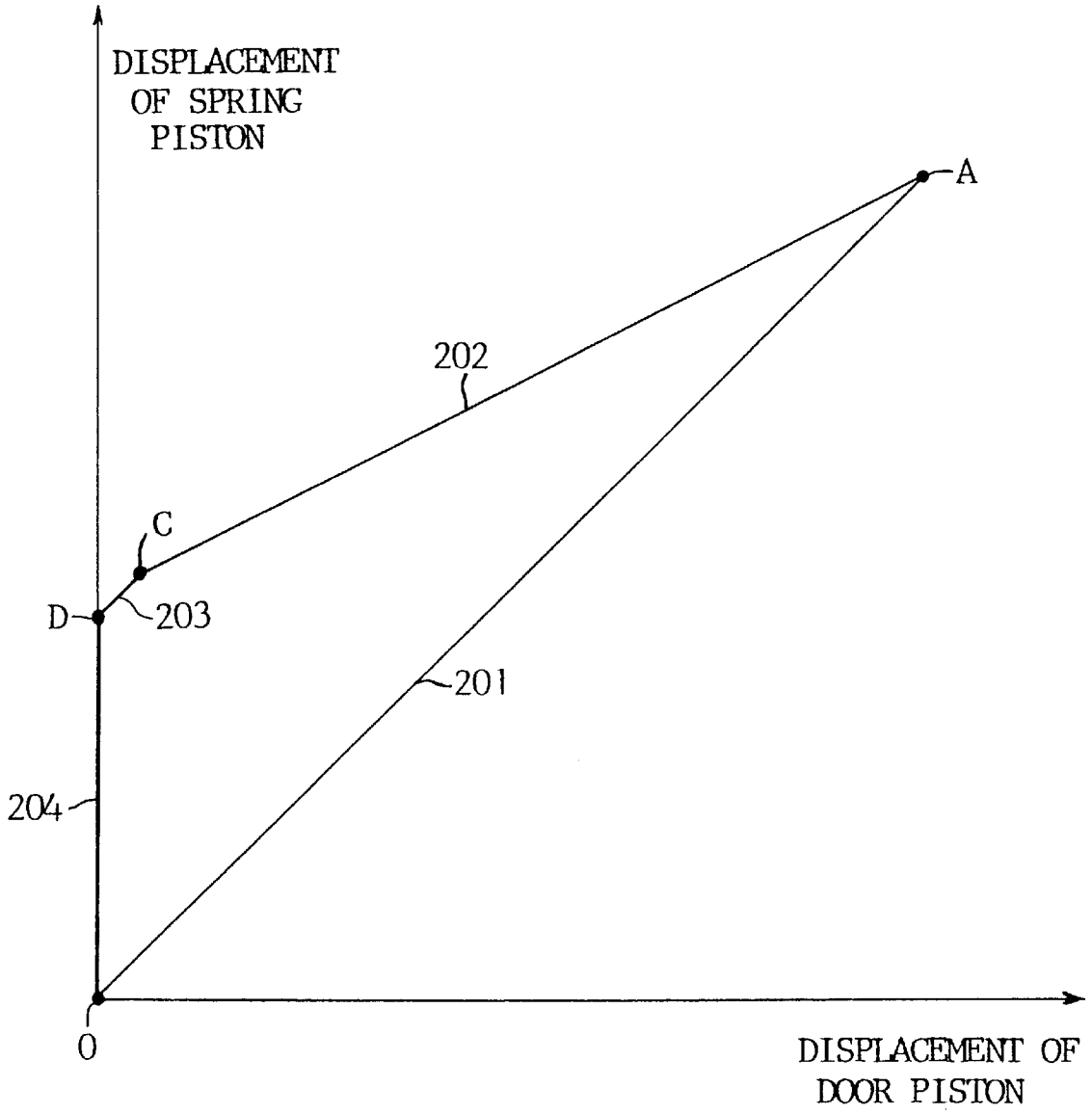
FIG. 5 is a diagram of the displacement characteristic of a possible embodiment of a servo door closer.

FIG. 5 is a diagram representing the opening and closing process of a possible embodiment of the present invention. The horizontal, or x, axis represents the displacement of the door piston 2 from its closed position (at the origin, labeled "O") to an opened position. The vertical, or y axis, represents the corresponding displacement of the spring piston 3 as a function of the displacement of the door piston 2 from its closed position (at the origin "O") to an opened position. The slope (the ratio of a change in the vertical axis divided by the corresponding change in the horizontal axis) of the displacement curve corresponds to a translation ratio of the door closer as described above.

The door closer is initially in its closed position, corresponding to the embodiment as illustrated in FIG. 1. The closed position defines a point "O" at the origin where the displacement of both the spring piston 2 and the door piston 3 from their initial, idle position, is zero. The door is then opened to the open position illustrated in FIG. 2, corresponding to the point "A" of FIG. 5. During the opening phase of the door, the translation ratio is 1. Therefore, during the opening phase of the door, the displacement of the door piston 3 equals the displacement of the spring piston 2. The slope of the displacement curve 201 is substantially equal to one, i.e., the displacement curve 201 makes substantially a 45 degree angle with the horizontal axis. During this opening phase of the door, the speed of the door piston 3 essentially equals the speed of spring piston 2.

From the open position, the door is released and the door closer closes to the operating position illustrated in FIG. 3, corresponding to the point "C" of FIG. 5. Because damping medium can enter the work chamber 31 via pocket 19 immediately upon closing, the door piston 3 begins to immediately uncouple from the spring piston 2 when the door is released. This corresponds to the second part of the closing phase (the first part of the closing phase being eliminated in the illustrated embodiment). The translation ratio is therefore less than one and the displacement curve 202 between "A" and "C" has a slope throughout of less than one. Because the door piston 3 moves a greater distance than spring piston 2 during the same time interval, the speed of door piston 3 is greater than the speed of spring piston 2 between "A" and "C".

Upon closing to the operating position illustrated in FIG. 3, the chamber 31 is sealed, and the inner work chamber 18 is opened to spring chamber 21. From Point "C" to Point "D", corresponding to the displacement curve 203, the work chamber 31 is essentially sealed, and the volume of work chamber 31 remains constant until the door piston 3 essentially reaches its final closed position corresponding to point "D". The door piston 3 can thereby be displaced to its final closed position corresponding to the point "D" of FIG. 5, moving along the displacement curve 203. Note that at "D" the door piston 3 has returned to its original non-displaced location, but that the spring piston 2 has not. A channel thereby opens to drain chamber 31, and the spring piston 2 can return via displacement curve 204 to its original non-displaced location, placing the door closer in its original closed position represented by the origin "O".

When closing, and as illustrated in FIG. 5, the spring piston 2 must move a greater distance from point "C" to its closed position at "O" than does the door piston 3. Therefore the effective translation ratio of the door closer for the closing phase from point "C" to point "O" is greater than one. Hence the spring piston 2 is moving faster than the door piston 3 when moving from point "C" to point "O".

Figure 6:
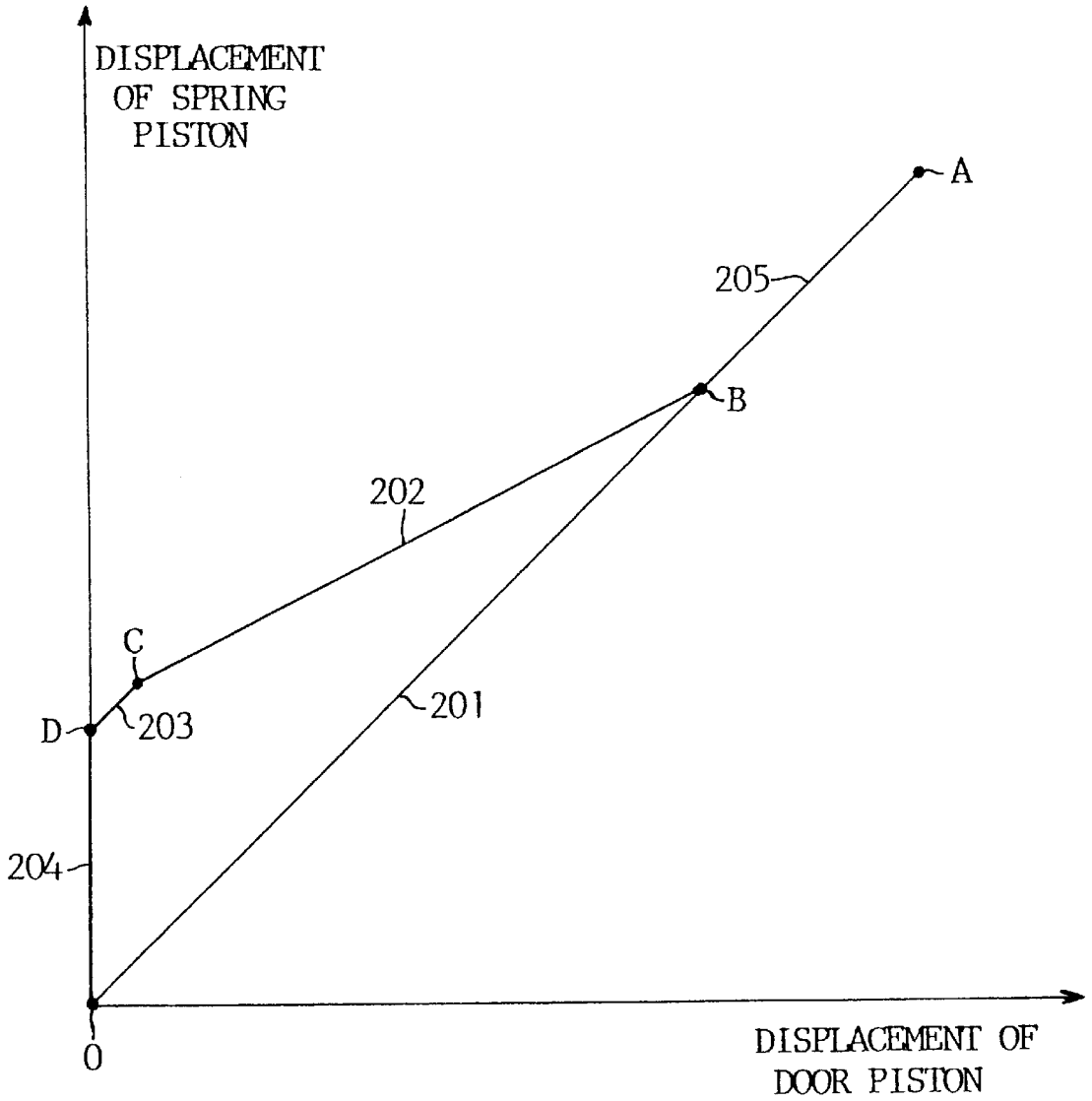
FIG. 6 is a diagram of the displacement characteristic of another possible embodiment of a servo door closer.

FIG. 6 is a diagram representing the opening and closing process of another alternative embodiment of the present invention. FIG. 6 corresponds to FIG. 5, with corresponding features of the displacement curve identified as in FIG. 5. The embodiment represented in FIG. 6 also includes a first part of the closing phase whereby the spring piston 2 directly engages the door piston 3 while the door closes from its open position "A" to the position "B". At position "B", the second part of the closing phase begins as the chamber 31 is pressurized by damping medium to decouple or separate the door piston 3 and the spring piston 2.

An embodiment of the present invention can be realized that reduces the risk of catching one's fingers within the closing door. The door closer can generate a high seating or latching force once the door has substantially reached the door's closing position. Because the door piston 3 can move at a substantially faster speed than does the spring piston 2 for a portion of the closing phase, a relatively low closing force can be applied prior to the door reaching a substantially closed position. Upon reaching the substantially closed position, the spring piston 2 has not yet reached its idle position (corresponding to the idle position shown in FIG. 1).

Hence the spring 1 remains compressed as discussed above, and can exert a higher seating or latching force than can be exerted when the spring piston 2 finally reaches its idle position. The higher seating or latching force can be applied by the spring 1 when the door reaches its substantially closed position, and not before. Therefore it is not necessary for the higher seating or latching force to be applied to the door prior to the door substantially reaching its closed position that could cause an acceleration of the door to the closed position, thereby increasing the risk of catching one's fingers in the door.

It should be readily apparent that a number of operating parameters and characteristics of the present invention can be modified to realize embodiments of door closers that can suit a wide variety of operating conditions without departing from the spirit and scope of the present invention.

One feature of the invention resides broadly in the hydraulic servo door closer with a door piston 3 guided in a housing 5, the drive axis 7 of which door piston 3 is connected by means of a linkage with a door, and an energy storage device in the form of a spring 1 which, during the opening of the door, is supplied with the energy necessary for the subsequent automatic closing of the door, characterized by the fact that the servo door closer has at least two different translation ratios and thus different moment curves as a function of distance and direction, and simultaneously the fixed coupling between opening force and closing force is neutralized, that between the spring 1 and the door piston 3 there is at least one hydraulic transmission which consists of at least one spring piston 2, the door piston 3 and an inner piston 10 inside the door piston 3, and the chamber defined by this inner piston 10 and a housing 5 which surrounds the inner piston 10, whereby and during the closing phase, the door piston 3 is moved away from the spring piston 2 and an area to be determined.

Another feature of the invention resides broadly in the hydraulic servo door closer characterized by the fact that, and in at least one of the piston surfaces 25 or 26 of the door piston 3 or of the spring piston 2 there is a recess 20.

Yet another feature of the invention resides broadly in the hydraulic servo door closer characterized by the fact that an inner piston chamber 18 is connected to a spring piston chamber 21 by means of a pocket 19 in the housing 5.

Still another feature of the invention resides broadly in the hydraulic servo door closer characterized by the fact that when the door is in the closed position, the piston surface 26 of the spring piston 2 comes into contact with the piston surface 25 of the door piston 3.

A further feature of the invention resides broadly in the hydraulic servo door closer characterized by the fact that there is a door piston chamber 24 which is connected to the spring chamber 21 by means of a channel 12.

Another feature of the invention resides broadly in the hydraulic servo door closer characterized by the fact that there is a throttle valve 11 in the channel 12.

Yet another feature of the invention resides broadly in the hydraulic servo door closer characterized by the fact that the throttle valve 11 is a flow control valve.

Still another feature of the invention resides broadly in the hydraulic servo door closer characterized by the fact that there is a connecting channel 9 from the door piston chamber 24 to the inner piston chamber 17.

A further feature of the invention resides broadly in the hydraulic servo door closer characterized by the fact that there is a channel 14 which is pressurized by a non-return valve 13, which channel extends from the door piston chamber 24 to the inner piston chamber 18.

Another feature of the invention resides broadly in the hydraulic servo door closer characterized by the fact that when the door is opened, the spring piston 2 and the door piston 3 are moved at the same speed by a pressure equalization between the door piston chamber 24 and the inner piston chamber 17.

Yet another feature of the invention resides broadly in the hydraulic servo door closer characterized by the fact that the inner piston 10 is positively and non-positively fastened on the housing 5.

Still another feature of the invention resides broadly in the hydraulic servo door closer characterized by the fact that during the closing of the door, a chamber 31 filled with damping medium is formed between the piston surfaces 25, 26, whereby the pressure which builds up in this chamber 31 can be discharged by means of a channel 16 to the spring chamber 21.

A further feature of the invention resides broadly in the hydraulic servo door closer characterized by the fact that the channel 16 can have a throttled cross section.

Some examples of door closers which could possibly be used or which could possibly be adapted for use in the context of the present invention might be disclosed by the following U.S. Patents, all of which have been assigned to the assignee of the present invention: U.S. Pat. Nos. 5,461,754, 5,311,642, 4,999,872, 4,937,913 and 4,660,250.

Other examples of door closers which could possibly be used or possibly be adapted for use in the context of the present invention, along with additional components generally associated with door closers, might be disclosed by the following U.S. Patents: U.S. Pat. Nos. 5,414,894, 5,386,614, 5,259,090, 5,206,971 and 4,979,261.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 38 482.2, filed on Oct. 17, 1995, having inventors Peter Krumhauer and Thomas Salutzki, and DE-OS 195 38 482.2 and DE-PS 195 38 482.2, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A door closer for connection between a door and a door frame, said door closer comprising:

a housing;

said housing comprising means for attachment to one of: the door and the door frame;

a piston structure being disposed in said housing;

said piston structure comprises a first piston;

means for connecting said piston structure to the other of: the door and the door frame;

an energy storage arrangement for storing energy during the opening of the door for subsequently closing the door;

said energy storage arrangement also being disposed in said housing;

means for moving both said piston structure and said energy storage arrangement during an opening movement of the door;

said energy storage arrangement comprising:

a spring;

a second piston configured to be acted upon by said spring; and said energy storage arrangement being disposed substantially adjacent to said piston structure;

said spring being disposed to move along substantially the same path of movement as said piston structure; and an arrangement to permit movement of said piston structure and said second piston during a closing movement of the door and to permit movement of said piston structure at a substantially higher speed than the speed of said second piston during a substantial portion of the closing movement of the door.

2. The door closer according to claim 1, wherein said arrangement to permit movement of said piston structure and said second piston and to permit movement of said piston structure at a substantially higher speed than the speed of said second piston during a substantial portion of the closing movement of the door comprises hydraulic means for regulating the movement of said piston structure and the movement of said second piston during the substantial portion of the closing movement of the door.

3. The door closer according to claim 2, wherein:

said housing comprises a longitudinal axis;

said housing has a first end and a second end;

said first end of said housing is axially opposite said second end of said housing;

said hydraulic means comprises:

a first chamber;

said first chamber is disposed within said housing;

damping medium; and said damping medium is disposed within said first chamber;

said first piston is disposed within said first chamber;

said first piston is disposed adjacent to said first end of said housing;

said second piston is disposed within said first chamber;

said second piston is disposed adjacent to said second end of said housing;

said spring is operatively connected between said second end of said housing and said second piston to exert a substantially axial force on said second piston towards said first piston;

said first piston comprises a first surface;

said second piston comprises a second surface;

said first surface of said first piston is disposed adjacent to said second surface of said second piston;

a portion of said first surface is configured to contact a portion of said second surface when said first piston contacts said second piston;

said hydraulic means further comprises:

said first chamber is configured to guide movement of each of said first and second pistons substantially parallel to the longitudinal axis of the housing;

a second chamber;

said second chamber is disposed between said first piston and said second piston; and at least one of: said first surface and said second surface is configured to form a portion of said second chamber; and means for permitting flow of damping medium into said second chamber between said first piston and said second piston during the substantial closing movement of the door.

4. The door closer according to claim 3, wherein:

said means for damping medium flow into said second chamber between said first piston and said second piston during the substantial closing movement of the door comprises:

a third chamber;

said third chamber is disposed within said first piston;

an inner piston;

said inner piston is disposed within said third chamber;

said third chamber is configured to permit relative axial movement between said first piston and said inner piston;

said inner piston is disposed to sealingly divide said third chamber into a first portion and a second portion;

said first portion of said third chamber is disposed between said inner piston and said first end of said housing;

said second portion of said second chamber is disposed between said inner piston and said second end of said housing;

a first channel; and said first channel is configured to permit flow of damping medium from said second portion of said third chamber to said second chamber during the substantial portion of the closing of the door.

5. The door closer according to claim 4, wherein:

said first chamber comprises a first portion and a second portion;

said first portion of said first chamber is located between said first end of said housing and said first piston;

said second portion of said first chamber is located between said second end of said housing and said second piston; and said hydraulic means comprises:

means for fixedly attaching said inner piston with respect to said housing;

means for permitting flow of damping medium between said first and second portions of said first chamber;

means for permitting flow of damping medium between said first chamber and said third chamber during an opening movement of the door to equalize the pressure within said first and third chambers during an opening movement of the door;

means for permitting flow of damping medium into said second portion of said third chamber during an opening movement of the door; and means for permitting flow of damping medium from between said first and second pistons after the substantial closing movement of the door.

6. The door closer according to claim 5, wherein:

said means for permitting flow of damping medium between said first and second portions of said first chamber comprises a second channel;

said second channel is disposed within said housing;

said second channel is disposed between said first and second portions of said first chamber;

said means for permitting flow of damping medium between said first and second portions of said first chamber comprises means for throttling flow of damping medium in said second channel;

said means for throttling flow of damping medium in said second channel comprises a flow control valve;

said flow control valve is disposed in said second channel;

said means for permitting flow of damping medium flow between said first chamber and said third chamber during an opening movement of the door comprises:

a third channel;

said third channel is disposed within said first piston;

said third channel is disposed between said first portion of said first chamber and said first portion of said third chamber;

a fourth channel;

said fourth channel is disposed in said first piston;

said fourth channel is disposed between said first portion of said first chamber and said second portion of said third chamber;

a non-return valve;

said non-return valve is disposed in said fourth channel; and said non-return valve is configured to prevent flow of damping medium from said second portion of said third chamber to said first portion of said first chamber;

said means for permitting flow of damping medium from between said first and second pistons after the substantial closing movement of the door comprises a fifth channel;

said fifth channel is disposed in said housing;

said fifth channel is configured for permitting flow of damping medium from between said first and second pistons after the substantial closing movement of the door to the first chamber;

said means for permitting flow of damping medium from between said first and second pistons after the substantial closing movement of the door comprises means for throttling flow of damping medium in said fifth channel;

said means for throttling flow of damping medium in said fifth channel comprises a portion of said fifth channel; and the cross-section of said portion of said fifth channel is configured to throttle flow of damping medium through said portion of said fifth channel.

7. A door closer for connection between door and frame members, said door closer comprising:

a housing;

said housing comprising means for attachment to one of: the door member and the frame member;

a piston structure disposed in said housing;

said piston structure comprising a first piston;

said first piston being moveable in a first direction and a second direction;

the second direction being substantially opposite the first direction;

means for linking said piston structure to the other of: the door member and the frame member;

said means for linking said piston structure comprising:

means for moving said first piston in the first direction in response to movement of the door member in an opening direction relative to the frame member; and means for moving the door member in a closing direction relative to the frame member in response to movement of said first piston in the second direction;

energy storage means for storing energy in response to movement of the door member in an opening direction relative to the frame member for subsequently closing the door member;

said energy storage means comprising:

a second piston; and a spring;

said energy storage means also being disposed in said housing;

said second piston being moveable in a third direction and a fourth direction;

the fourth direction being substantially opposite the third direction; and transmission means for operatively connecting a portion of the movement of said first piston in the second direction and said second piston in the fourth direction in response to a substantial portion of the movement of the door member in a closing direction relative to the frame member and for moving said first piston a substantially greater distance than the distance of said second piston.

8. Hydraulic servo door closer with a door piston guided in a housing, a drive axis of the door piston is connected by a linkage with a door having a closed position and an open position, and an energy storage device comprising a spring, which spring has an energized position and a de-energized position, which spring, upon moving the door to the open position, is moved to the energized position for the subsequent automatic moving of the door to the closed position, comprising:

the servo door closer has at least two different translation ratios and thus different moment curves as a function of distance and direction, and simultaneously the fixed coupling between opening force and closing force is neutralized, that between the spring and the door piston there is at least one hydraulic transmission which consists of at least one spring piston, the door piston and an inner piston inside the door piston, and the chamber defined by the inner piston and a housing which surrounds the inner piston, the door piston is adjacent to the spring piston upon the door being in the closed position and upon the door being in the open position, the door piston is disposed a distance away from the spring piston upon the door being moved from the open position to the closed position.

9. The hydraulic servo door closer according to claim 8, wherein:

the door piston comprises a first piston surface;

the spring piston comprises a second piston surface; and a recess is disposed in at least one of: the first piston surface and the second piston surface.

10. The hydraulic servo door closer according to claim 9, comprising:

an inner piston chamber and a spring piston chamber;

the inner piston chamber is connected to the spring piston chamber by means of a pocket in the housing.

11. The hydraulic servo door closer according to claim 10, wherein when the door is in the closed position, the piston surface of the spring piston comes into contact with the piston surface of the door piston.

12. The hydraulic servo door closer according to claim 11, wherein there is a door piston chamber which is connected to the spring chamber by means of a channel.

13. The hydraulic servo door closer according to claim 12, wherein there is a throttle valve in the channel.

14. The hydraulic servo door closer according to claim 13, wherein the throttle valve is a flow control valve.

15. The hydraulic servo door closer according to claim 14, wherein a second channel extends from the door piston chamber to the inner piston chamber.

16. The hydraulic servo door closer according to claim 15, wherein a third channel which is pressurized by a non-return valve, which third channel extends from the door piston chamber to the inner piston chamber.

17. The hydraulic servo door closer according to claim 16, wherein when the door is opened, the spring piston and the door piston are moved at the same speed by a pressure equalization between the door piston chamber and the inner piston chamber.

18. The hydraulic servo door closer according to claim 17, wherein the inner piston is positively and non-positively fastened on the housing.

19. The hydraulic servo door closer according to claim 18, wherein during the closing of the door, a second chamber filled with damping medium is formed between the piston surface of the spring piston and the piston surface of the door piston, whereby the pressure which builds up in the second chamber can be discharged by means of a fourth channel to the spring chamber.

20. The hydraulic servo door closer according to claim 19, wherein the fourth channel comprises a throttled cross section.

* * * * *